US005334218A

United States Patent [19]

Johnson

[11] Patent Number: 5,334,218

[45] Date of Patent: Aug. 2, 1994

[54] TEETHING PACIFIER WITH SEMI-CIRCULAR TEETHING MEMBER

[76] Inventor: Jill C. Johnson, 1714 E. 30th Pl., Tulsa, Okla. 74114

[21] Appl. No.: 130,029

[22] Filed: Sep. 30, 1993

[51] Int. Cl.[5] ..... A61J 17/02

[52] U.S. Cl. ..... 606/235; 606/234

[58] Field of Search ..... 128/62 A; 606/1, 234–236; 215/11.1–11.6; D24/194–199

[56] References Cited

U.S. PATENT DOCUMENTS

| | | | |
|---|---|---|---|
| 516,561 | 3/1894 | Bosch . | |
| 823,076 | 6/1906 | Pinsent . | |
| 1,586,499 | 5/1926 | Worth . | |
| 3,610,248 | 10/1971 | Davidson . | |
| 3,669,117 | 6/1972 | Herbst . | |
| 4,192,307 | 3/1980 | Baer . | |
| 4,447,164 | 5/1984 | Berndt . | |
| 4,856,663 | 8/1989 | Epp | 215/11.1 |
| 4,915,242 | 4/1990 | Marte | 215/11.1 |

*Primary Examiner*—Stephen C. Pellegrino
*Assistant Examiner*—Glenn Dawson
*Attorney, Agent, or Firm*—Head & Johnson

[57] ABSTRACT

A combination infant pacifier/teether having a nipple member with a bulbous forward portion and a rearward portion. The rearward portion extends forwardly from an enlarged diameter shield. A handle is affixed to the rearward surface of the shield and a semi-circular teething member extends forwardly of the shield adjacent the nipple member. The teething member is sized and configured to conform to the shape of the alveolar ridge of an infant.

4 Claims, 1 Drawing Sheet

TEETHING PACIFIER WITH SEMI-CIRCULAR TEETHING MEMBER

BACKGROUND OF THE INVENTION

As teeth grow in an infant they ultimately must protrude or break through the skin or gum line that defines the upper or lower alveolar ridge of the infant. Some pain is naturally caused by the tooth penetrating the gum line which can cause substantial discomfort to the infant. To help alleviate the pain and, at the same time, to help the growing teeth penetrate the gum line, it has long been a custom to provide teethers for infants. Teethers are typically generally flat objects that extend within the mouth of the infant so that the infant can close their upper and lower gums against the object to apply gentle pressure to the areas wherein teeth are in the process of penetrating the gum line to afford relief to the infant.

Another object frequently employed conforms to an infant's natural sucking instinct and is called a "pacifier". Pacifiers typically have a bulbous portion, a flat shield to prevent the infant from swallowing the device and rearward of the shield a handle portion that can be used for placing the pacifier into the infant's mouth or for removing it from the infant's mouth. An infant tends to keep a pacifier in his/her mouth automatically because of the natural sucking instinct. On the other hand, a teether does not respond to the natural sucking instincts and while a teether affords relieve from pain, infants seldom are able to keep a teether in his/her mouth for any extended length of time. This requires the caregiver to constantly replace a teether that has dropped out of an infant's mouth.

An object of this invention is to provide a teething device including the benefits of a pacifier so that the infant will tend to keep the teether in his/her mouth for a more sustained length of time.

For reference to prior art relating to teethers or pacifiers see the following U.S. Pat. Nos. 516,561; 823,076; 1,586,499; 3,610,248; 3,669,117; 4,192,307; 4,447,164; 4,856,663; and 4,915,242.

U.S. Pat. Nos. 4,192,307; 3,610,248; 4,447,164; 4,915,242; 3,669,117; and 823,076 show various type pacifiers that are effective for permitting an infant to exercise the instinctive sucking action but do not provide for a teething action.

U.S. Pat. No. 516,561 shows a type of teether but does not include any means to help the infant keep the teether in his/her mouth for an extended length of time.

U.S. Pat. No. 4,856,663 shows a type of pacifier specifically designed for a child with a cleft palate. U.S. Pat. No. 1,586,499 is a tooth exerciser showing a device generally of the configuration employed in teethers but meant as a tooth exerciser and not meant for use as a teether.

These prior art references demonstrate the state of the art which does not disclose, to the knowledge of Applicant, a device for teething including a means of helping the infant maintain the teether within his/hers mouth.

SUMMARY OF THE INVENTION

The invention is a combination infant pacifier and teether. It is formed of a nipple member having a bulbous forward portion and a rearward portion.

An enlarged diameter generally flat planar shield member has a forward and rearward surface. The nipple member rearward portion is affixed to the shield member forward surface. The shield member is of diameter sufficient to make certain that the infant cannot get the device within his/her mouth so as to prevent the infant from attempting to swallow or from choking on the combination pacifier/teether.

A handle, generally of an integral loop portion, extends from the shield member rearward surface.

A teething member is affixed to and extends in opposite directions from opposed sides of the nipple member rearward portion. The teether member is generally semi-circular in configuration and is relatively thin and flat with opposed top and bottom surfaces.

The combination infant pacifier/teether is used by placing the forward portion in the infant's mouth. The bulbous nipple portion provides for the infant to exercise his/her natural sucking instinct and functions not only as a pacifier but to help maintain the device within the mouth of the infant. The teething member provides surfaces against which the infant can use for exercising the gum lines by natural biting action to thereby help the infant cause the growing tooth to more quickly and painlessly extend through the alveolar ridge gum line.

A better understanding of the invention will be obtained from the following description of the preferred embodiment and the claims, taken in conjunction with the attached drawings.

DESCRIPTION OF THE PREFERRED EMBODIMENT

Figure 1:
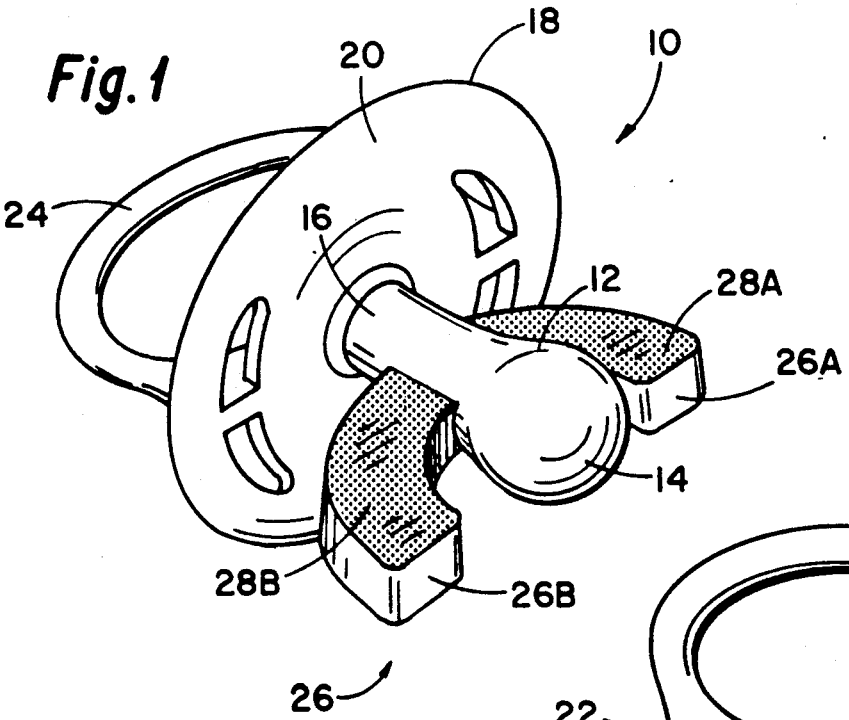
FIG. 1 is an isometric view of a combination infant pacifier/teether of this invention showing a preferred embodiment.
Figure 2:
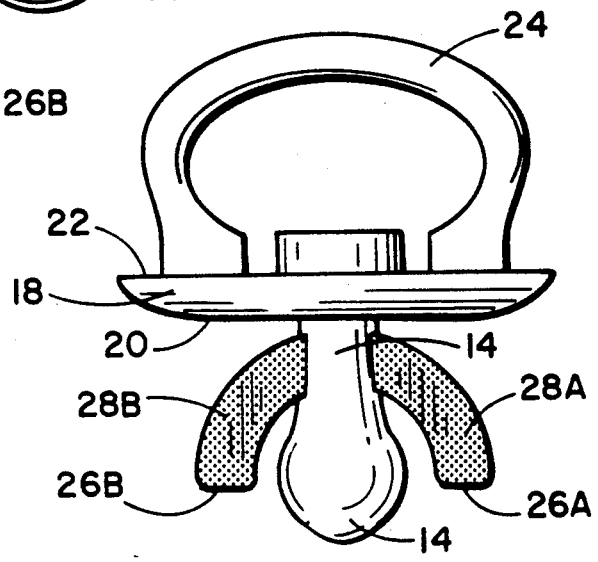
FIG. 2 is a top plane view of the pacifier/teether of FIG. 1.
Figure 3:
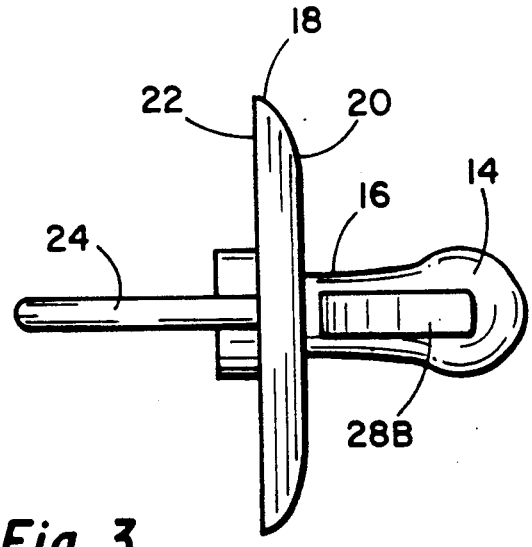
FIG. 3 is a side view of the pacifier/teether of FIG. 1.

Referring to the drawings, the combination infant pacifier/teether is generally indicated by the numeral 10 and includes the basic components of: a nipple member 12 having a bulbous forward portion 14 and a reduced diameter rearward portion 16; an enlarged diameter shield member 18 having a forward surface 20 and a rearward surface 22; a handle member 24 affixed to and extending from the shield member rearward surface 22; and a teething member 26 extending forwardly of the shield forward surface 20 and adjacent to and spaced either side of the nipple member bulbous portion 12.

The elements 12 through 24 are more or less standard portions of a typical pacifier, that is, a shield member 18 with a handle 24 extending from the rearward surface 22 and a bulbous nipple portion extending from forward surface 20. A configuration of handle 24 can vary considerably and may be any shape that is suitable to be grasped by a caregiver or by the infant. In like manner, the shape of the shield may vary considerably. It does not have to be round but can be oval or other shapes and its main function is to provide a surface area that is too large for the infant to take into his/her mouth and to thereby prevent the infant from choking on the pacifier. The bulbous nipple portion 14, 16 can vary in shape also but the function is the same, that is, to cause the infant to utilize the device for exercising his/her natural sucking instinct.

Figure 4:
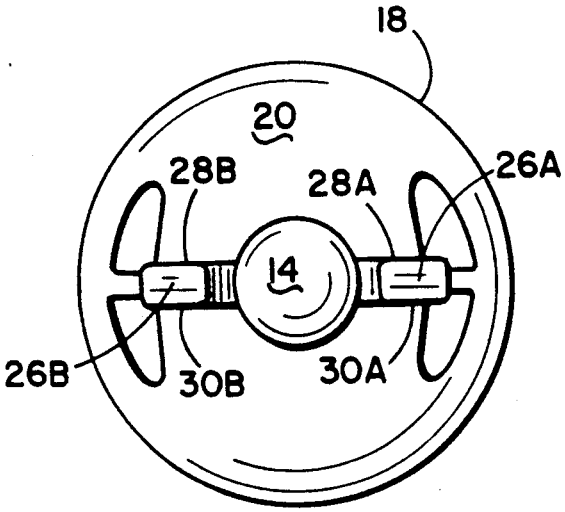
FIG. 4 is a front view of the pacifier/teether of FIG. 1.

A teether portion in combination with a pacifier is the unique concept of this disclosure. The teether, generally indicated by the numeral 26, in the illustrated and preferred embodiment includes two oppositely extending semi-circular portions 26A and 26B. The semi-circular portions extend to opposite sides of the nipple member bulbous portion 14 and each has an upper and a lower surface. The upper surface of portion 26A is indicated by the numeral 28A, and the upper surface of portion 26B is indicated by the numeral 28B. The teether member 26 further has a lower surface (see FIG. 4) indicated by the numeral 30A and 30B. The use of "upper" and "lower" is relative since the device is preferably symmetrical and can be turned in either of two orientations with respect to the infant's mouth, that is, upper surfaces 28A and 28B may, if the device is rotated 180 degrees, actually contact the infant's lower gum line. Thus, the device does not have a preferred "upper" and "lower" orientation.

Teething member 26 is shown as extending from nipple member rearward portion 16. It can be seen that the teething member could extend from shield member forward surface 20.

The entire device may be of one piece, although in some embodiments it may be preferred that bulbous nipple portion 14 and teething member 26 have different degrees of elasticity or softness. Further, while nipple portion 14 is preferably smooth the upper and lower surfaces of the teething member may preferably be rough as indicated, that is, provided with a texture, so as to stimulate action against the gum of the infant.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A combination infant pacifier and teether comprising:

a nipple member having a bulbous forward portion and a rearward portion;

an enlarged diameter shield member having a forward and a rearward surface, said nipple member rearward portion being affixed to said shield member forward surface;

a handle affixed to said shield member rearward surface; and a generally semi-circular teething member supported by and extending forwardly of said shield member forward surface and adjacent said nipple member, the teething member having at least one unattached free end.

2. A combination infant pacifier and teether according to claim 1 wherein said teething member is dimensioned to conform to an alveolar ridge of a typical infant.

3. A combination infant pacifier and teether according to claim 1 wherein said teething member is in the form of a generally planar portion attached to and extending arcuately from opposed sides of said nipple member rearward portion and having opposed unattached free ends.

4. A combination infant pacifier and teether according to claim 1 wherein said teether member is in the form of a generally planar portion extending arcuately from at least one side of said nipple member rearward portion.

* * * * *